US010405605B2

(12) United States Patent
Cross et al.

(10) Patent No.: US 10,405,605 B2
(45) Date of Patent: Sep. 10, 2019

(54) ARTICLE OF FOOTWEAR WITH AUXETIC SOLE ASSEMBLY FOR PROPRIOCEPTION

(71) Applicant: NIKE, Inc., Beaverton, OR (US)

(72) Inventors: Tory M. Cross, Portland, OR (US); Bryan N. Farris, North Plains, OR (US); Elizabeth Langvin, Sherwood, OR (US)

(73) Assignee: NIKE, Inc., Beaverton, OR (US)

( * ) Notice: Subject to any disclaimer, the term of this patent is extended or adjusted under 35 U.S.C. 154(b) by 194 days.

(21) Appl. No.: 15/604,887

(22) Filed: May 25, 2017

(65) Prior Publication Data

US 2018/0338574 A1 Nov. 29, 2018

(51) Int. Cl.

| | |
|---|---|
| ***A43B 13/12*** | (2006.01) |
| ***A43B 13/18*** | (2006.01) |
| ***A43B 13/22*** | (2006.01) |
| ***A43B 7/14*** | (2006.01) |

(52) U.S. Cl.

CPC ..... *A43B 13/186* (2013.01); *A43B 7/146* (2013.01); *A43B 13/12* (2013.01); *A43B 13/122* (2013.01); *A43B 13/188* (2013.01); *A43B 13/189* (2013.01); *A43B 13/223* (2013.01)

(58) Field of Classification Search

CPC ..... A43B 7/146; A43B 13/00; A43B 13/02; A43B 13/12; A43B 13/125; A43B 13/127

USPC ..... 36/25 R, 30 R, 141

See application file for complete search history.

(56) References Cited

U.S. PATENT DOCUMENTS

| | | | | |
|---|---|---|---|---|
| 4,663,865 | A * | 5/1987 | Telecemian | A43B 13/181 36/114 |
| 5,551,173 | A | 9/1996 | Chambers | |
| 5,564,202 | A | 10/1996 | Hoppenstein | |
| 6,691,432 | B2 | 2/2004 | Masseron | |
| 7,140,129 | B2 | 11/2006 | Newson et al. | |
| 2003/0101620 | A1* | 6/2003 | Reed | A43B 7/1425 36/30 A |
| 2009/0183392 | A1 | 7/2009 | Shane | |
| 2010/0058620 | A1* | 3/2010 | Cox | A43B 1/0027 36/30 R |
| 2010/0192408 | A1 | 8/2010 | Righetto | |
| 2013/0086823 | A1* | 4/2013 | Park | A43B 7/082 36/30 R |
| 2014/0101816 | A1 | 4/2014 | Torogjo | |
| 2015/0245683 | A1* | 9/2015 | Cross | B32B 27/065 36/103 |
| 2017/0238652 | A1* | 8/2017 | Langvin | A43B 13/04 |
| 2018/0338571 | A1* | 11/2018 | Cross | A43B 13/04 |
| 2018/0338572 | A1* | 11/2018 | Cross | A43B 3/0073 |

(Continued)

FOREIGN PATENT DOCUMENTS

WO 2016053443 A1 4/2016

*Primary Examiner* — Marie D Bays

(74) *Attorney, Agent, or Firm* — Quinn IP Law

(57) ABSTRACT

An article of footwear and a sole structure including an auxetic sole assembly are described. The auxetic sole assembly includes an auxetic layer and a base layer. The auxetic layer is made of an auxetic material and includes a plurality of apertures. Portions of the base layer are disposed within the apertures of the auxetic layer. Upon the application of force, portions of the base layer extend upwards through the apertures of the auxetic layer to form a plurality of protuberances. The plurality of protuberances can be used for proprioception.

17 Claims, 12 Drawing Sheets

(56) References Cited

U.S. PATENT DOCUMENTS

2018/0338573 A1* 11/2018 Cross ..... A43B 13/04
2018/0338574 A1* 11/2018 Cross ..... A43B 13/186

* cited by examiner

ARTICLE OF FOOTWEAR WITH AUXETIC SOLE ASSEMBLY FOR PROPRIOCEPTION

TECHNICAL FIELD

The present disclosure relates generally to articles of footwear for proprioception.

BACKGROUND

Articles of footwear generally include two primary elements: an upper and a sole structure. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper.

BRIEF DESCRIPTION OF THE DRAWINGS

The present disclosure can be better understood with reference to the following drawings and description. The components in the figures are not necessarily to scale, emphasis instead being placed upon illustrating the principles of the present teachings. Moreover, in the figures, like reference numerals designate corresponding parts throughout the different views.

DETAILED DESCRIPTION

Figure 1:
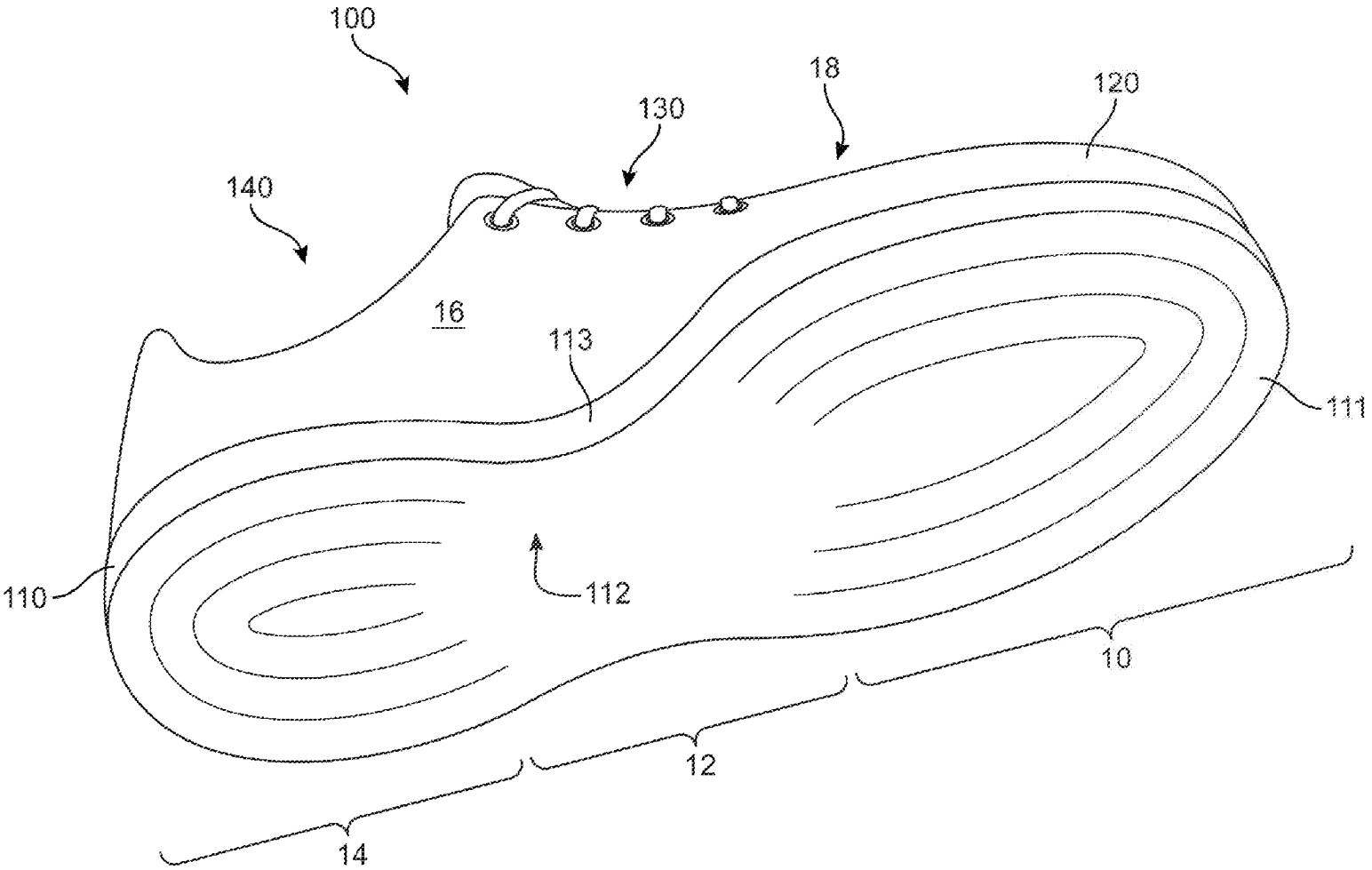
FIG. 1 is a schematic view of an exemplary embodiment of an article of footwear including an auxetic sole assembly.

The present disclosure describes an article of footwear. In one or more embodiments, the article of footwear includes an upper and a sole structure coupled to the upper. The sole structure an auxetic sole assembly. The auxetic sole assembly includes an auxetic layer defining a plurality of apertures. The auxetic sole assembly further includes a base layer disposed adjacent to the auxetic layer. The base layer includes a base body and a plurality of protuberances extending from the base body, and each of the plurality of protuberances is disposed within a respective one of the plurality of apertures. The protuberances of the base layer are configured to extend out from the plurality of apertures upon application of force to the auxetic sole assembly. The article of footwear may be tuned using auxetic structures. With the auxetic structures, the ride, fit, and cushioning across the sole structure can be customized. Such customization is generally not possible when using a monolithic rubber or foam sole. The heel region is configured to absorb energy, while providing lateral stability. The midfoot region can be stiffer than the heel region and/or non-auxetic, because the foot exerts very little contact pressure at the midfoot portion when compared with the heel region. The forefoot region has enough firmness and structure to enable a good/firm push-off without needing to dig out of a mushy cushion. The protuberances can also compress within the apertures of the auxetic sole assembly upon application of force to the auxetic sole assembly.

In one or more embodiments, the auxetic layer includes a first material, and the base layer includes a second material. The first material may be more rigid than a second material. The second material may be less rigid than the first material to allow the protuberances to extend out of the apertures upon application of force to the auxetic sole assembly.

In one or more embodiments, the upper defines an interior cavity. The base layer has a first state and a second state. Further, the base layer is configured to transition from the first state to the second state upon application of the force to the auxetic layer. Each of the protuberances is entirely disposed inside the respective one of the plurality of apertures and is entirely disposed below a top surface of the auxetic layer when the base layer is in the first state. Each of the protuberances extends through an entirety of a thickness of the auxetic layer via the respective one of the plurality of apertures, such that each of the protuberances extends beyond and above the top surface of the auxetic layer and into the interior cavity of the upper when the base layer is in the second state In one or more embodiments, the protuberances are configured to change height as a function of a magnitude of the force applied to the auxetic sole assembly.

In one or more embodiments, the protuberances are configured to provide proprioceptive feedback to a foot of a wearer of the article of footwear.

In one or more embodiments, the sole structure further includes an outsole, and the base layer is disposed between the auxetic layer and the outsole.

In one or more embodiments, the outsole includes an outsole body and a sidewall portion coupled to the outsole body. The outsole body defines an upper surface. The upper surface and the sidewall portion collectively define the recess. The sidewall surface surrounds the recess. The auxetic sole assembly is disposed within the recess. The sidewall portion extends around a periphery of the auxetic sole assembly.

The present disclosure also describes a sole structure for an article of footwear. In one or more embodiments, the sole structure includes an auxetic sole assembly. The auxetic sole assembly includes an auxetic layer defining a plurality of apertures. The auxetic sole assembly further includes a base layer disposed adjacent to the auxetic layer. The base layer includes a base body and a plurality of protuberances extending from the base body. Each of the protuberances are disposed within a respective one of the plurality of apertures. The protuberances of the base layer are configured to extend out from the plurality of apertures upon application of force to the auxetic sole assembly.

In one or more embodiments, the auxetic layer includes a first material, and the base layer includes a second material. The first material is more rigid than a second material, and the second material is less rigid than the first material to allow the protuberances to extend out of the apertures upon application of force to the auxetic sole assembly.

In one or more embodiments, the protuberances are configured to change height to provide proprioceptive feedback to a foot of a wearer of the sole structure.

In one or more embodiments, the protuberances change height dynamically as a function of a magnitude of force applied to the auxetic sole assembly.

In one or more embodiments, the auxetic layer is configured to expand in both a lateral direction and a longitudinal direction when the auxetic layer is under lateral tension. The auxetic layer is configured to expand in both the longitudinal direction and the lateral direction when the auxetic layer is under longitudinal tension.

In one or more embodiments, an amount of the base layer disposed within the plurality of apertures in the auxetic layer increases when the auxetic layer expands.

The present disclosure also describes a sole structure for an article of footwear. The sole structure includes an auxetic sole assembly having a forefoot assembly region, a heel assembly region, and a midfoot assembly region disposed between the forefoot assembly region and the heel assembly region. The auxetic sole assembly includes an auxetic layer defining a plurality of apertures. The auxetic sole assembly further includes a base layer disposed adjacent to the auxetic layer. The base layer includes a base body and a plurality of protuberances extending from the base body. Each of the protuberances is disposed within a respective one of the plurality of apertures. The protuberances are configured to extend out from the plurality of apertures upon application of force to the auxetic sole assembly. The plurality of protuberances includes a first group of protuberances disposed in the forefoot assembly region, a second group of protuberances disposed in the midfoot assembly region, and a third group of protuberances disposed in the heel assembly region.

In one or more embodiments, the first group of protuberances has a first height. The second group of protuberances has a second height. The first height is greater than the second height.

In one or more embodiments, the third group of protuberances has a third height. The third height is greater than the second height.

In one or more embodiments, the plurality of apertures in the auxetic layer includes first groups of apertures extending through the forefoot assembly region of the auxetic sole assembly, a second group of apertures extending through the midfoot assembly region of the auxetic sole assembly, and a third group of apertures extending through the heel assembly region of the auxetic sole assembly.

In one or more embodiments, the first group of apertures has a first size. The second group of apertures has a second size. The first size is larger than the second size.

In one or more embodiments, the third group of apertures has a third size, and the third size is smaller than the first size.

In one or more embodiments, the base layer includes a forefoot base region, a heel base region, and a midfoot base region disposed between the forefoot base region and the heel base region, the forefoot base region includes a first material, the midfoot base region includes a second material, and the heel base region includes a third material, and the second material is more rigid than the first material and the third material.

Other systems, methods, features and advantages of the present teachings will be, or will become, apparent to one of ordinary skill in the art upon examination of the following figures and detailed description. It is intended that all such additional systems, methods, features and advantages be included within this description and this summary, be within the scope of the present teachings, and be protected by the following claims.

The following discussion and accompanying figures disclose an article of footwear and a sole structure for an article of footwear. Concepts associated with the article of footwear disclosed herein may be applied to a variety of athletic footwear types, including skateboarding shoes, performance driving shoes, soccer shoes, running shoes, baseball shoes, basketball shoes, cross-training shoes, cycling shoes, football shoes, golf shoes, tennis shoes, walking shoes, and hiking shoes and boots, for example. The concepts may also be applied to footwear types that are generally considered to be non-athletic, including dress shoes, loafers, sandals, and work boots. Accordingly, the concepts disclosed herein apply to a wide variety of footwear types.

For consistency and convenience, directional adjectives are employed throughout this detailed description corresponding to the illustrated embodiments. The term "longitudinal," as used throughout this detailed description and in the claims, refers to a direction extending a length of a sole structure, i.e., extending from a forefoot region to a heel region of the sole structure. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a sole structure. In other words, the lateral direction may extend between a medial side and a lateral side of an article of footwear, with the lateral side of the article of footwear being the surface that faces away from the other foot, and the medial side being the surface that faces toward the other foot.

The term "horizontal," as used throughout this detailed description and in the claims, refers to any direction substantially parallel with the ground, including the longitudinal direction, the lateral direction, and all directions in between. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to an article of footwear, a sole structure, and individual components of a sole structure. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

FIGS. 1 through 8 illustrate an exemplary embodiment of an article of footwear 100, also referred to simply as article 100. In some embodiments, article of footwear 100 may include a sole structure 110 and an upper 120. For reference purposes, article 100 may be divided into three general regions: a forefoot region 10, a midfoot region 12, and a heel region 14, as shown in the Figures. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a medial side 16 and a lateral side 18, which extend through each of forefoot region 10, midfoot region 12, and heel region 14 and correspond with opposite sides of article 100. More particularly, medial side 16 corresponds with an inside area of the foot (i.e., the surface that faces toward the other foot) and lateral side 18 corresponds with an outside area of the foot (i.e., the surface that faces away from the other foot. Forefoot region 10, midfoot region 12, and heel region 14 and medial side 16, lateral side 18, are not intended to demarcate precise areas of article 100. Rather, forefoot region 10, midfoot region 12, and heel region 14 and medial side 16, lateral side 18 are intended to represent general areas of article 100 to aid in the following discussion. In addition to article 100, forefoot region 10, midfoot region 12, and heel region 14 and medial side 16, lateral side 18 may also be applied to sole structure 110, upper 120, and individual elements thereof.

In some embodiments, sole structure 110 includes at least an outsole 111 that may be the primary ground-contacting component. Outsole 111 includes a lower surface 112 that is configured to contact the ground. Outsole 111 also includes an upper surface 114 that is disposed opposite lower surface 112. In some embodiments, sole structure 110 may also include additional components, including an auxetic sole assembly 200, described in detail below. In various embodiments, outsole 111 may include features configured to provide traction with the ground, for example, outsole 111 can include one or more of a tread pattern, grooves, cleats, spikes, or other ground-engaging protuberances or elements disposed on lower surface 112.

In some embodiments, outsole 111 may further include a sidewall portion 113. Sidewall portion 113 extends vertically upwards from lower surface 112 and extends around a perimeter of outsole 111. In this manner, sidewall portion 113 forms a lip around the peripheral edge of outsole 111. As a non-limiting example, the sidewall portion 113 may extend along the entire periphery of the outsole 112. In an exemplary embodiment, upper surface 114 of outsole 111 can include a recess or cavity defined and surrounded by sidewall portion 113. Specifically, upper surface 114 and sidewall portion 113 collectively define the recess 115. The recess 115 in outsole 111 surrounded by sidewall portion 113 can be configured to receive additional components of sole structure 110, including components of auxetic sole assembly 200.

Upper 120 may include one or more material elements (for example, textiles, foam, leather, and synthetic leather), which may be stitched, adhesively bonded, molded, or otherwise formed to define an interior void configured to receive a foot. The material elements may be selected and arranged to selectively impart properties such as durability, air-permeability, wear-resistance, flexibility, and comfort. Upper 120 and sole structure 110 may be fixedly attached to each other to form article 100. For example, sole structure 110 may be attached (or otherwise coupled) to upper 120 with adhesive, stitching, welding, and/or other suitable techniques.

In some embodiments, article 100 can include a lacing system 130. Lacing system 130 extends forward from collar and throat opening 140 in heel region 14 over a lacing area 132 corresponding to an instep of the foot in midfoot region 12 to an area adjacent to forefoot region 10. Lacing area 132 also extends in the lateral direction between opposite edges on medial side 16 and lateral side 18 of upper 120. Lacing system 130 includes various components configured to secure a foot within upper 120 of article 100 and, in addition to the components illustrated and described herein, may further include additional or optional components conventionally included with footwear uppers.

Figure 2:
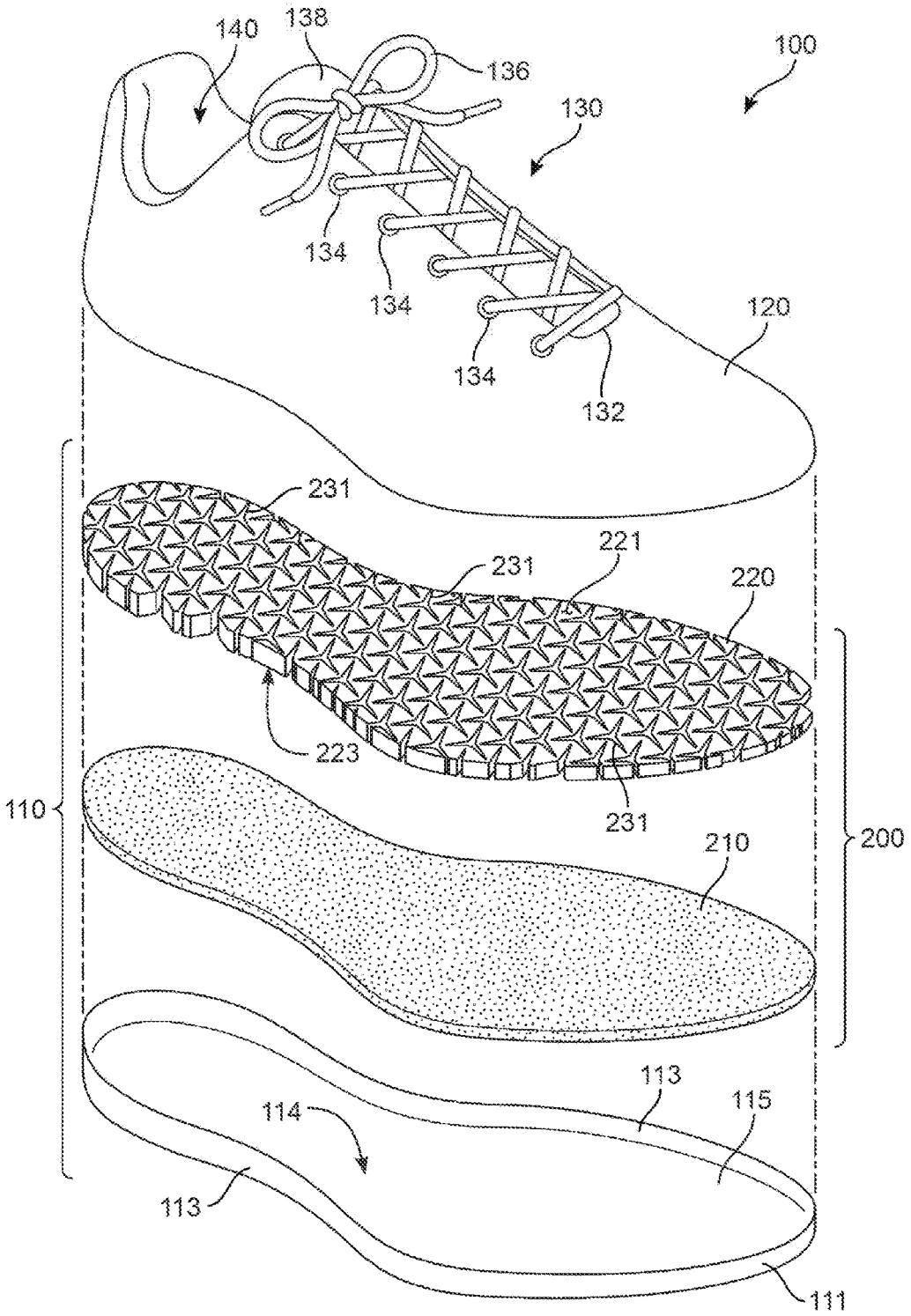
FIG. 2 is an exploded view of an exemplary embodiment of an article of footwear including an auxetic sole assembly.

As shown in FIG. 2, lacing system 130 also includes a lace 136 that extends through various lace-receiving elements to permit the wearer to modify dimensions of upper 120 to accommodate the proportions of the foot. In the exemplary embodiments, lace-receiving elements are configured as a plurality of lace apertures 134. More particularly, lace 136 permits the wearer to tighten upper 120 around the foot, and lace 136 permits the wearer to loosen upper 120 to facilitate entry and removal of the foot from the interior void (i.e., through ankle opening 140). Lace 136 is shown in FIG. 2, but has been omitted from the remaining Figures for ease of illustration of the remaining components of article 100.

As an alternative to plurality of lace apertures 134, upper 120 may include other lace-receiving elements, such as loops, eyelets, and D-rings. In addition, upper 120 includes a tongue 138 that extends over a foot of a wearer when disposed within article 100 to enhance the comfort of article 100. In this embodiment, tongue 138 extends through lacing area 132 and can move within an opening between opposite edges on medial side 16 and lateral side 18 of upper 120. In some cases, tongue 138 can extend beneath lace 136 to provide cushioning and disperse tension applied by lace 136 against a top of a foot of a wearer. With this arrangement, tongue 138 can enhance the comfort of article 100.

As shown in FIG. 2, sole structure 110 includes an auxetic sole assembly 200. Auxetic sole assembly 200 is configured to provide proprioceptive feedback to a foot of a wearer of article 100. The term "proprioception" means a conscious or unconscious awareness of a body part's movement and spatial orientation arising from stimuli. Proprioception enables a person to move their body in a desired manner. In the present embodiments, proprioception can be provided by auxetic sole assembly 200. As will be described in more detail below, auxetic sole assembly 200 can include protuberances that assist with providing proprioceptive feedback to a foot of a wearer. With this arrangement, a person wearing article 100 can have enhanced awareness of the location, orientation, and/or movement of a foot disposed within article 100 relative to the wearer's body and/or the ground.

In an exemplary embodiment, auxetic sole assembly 200 includes a base layer 210 and an auxetic layer 220. Base layer 210 can be formed from a material that has a smaller degree or amount of rigidity than auxetic layer 220. For example, base layer 210 may be formed by a lower density foam material, and auxetic layer 220 may be formed by a higher density foam material. In other words, the auxetic layer 220 is wholly or partly made of a first foam material having a higher density than the density of the foam material wholly or partly forming the base layer 210. In other embodiments, auxetic layer 220 may be made of other suitable materials that are more rigid than the materials forming base layer 210. With this configuration, when auxetic sole assembly 200 experiences a force, base layer 210 will be substantially deformed relative to auxetic layer 220 to form protuberances, as will be described below. Base layer 210 is adjacent to the auxetic layer 220, thereby allowing the base layer 210 to deform relative to the auxetic layer 220 upon application of a force F (FIG. 6) to the auxetic sole assembly 200. For instance, auxetic layer 220 is disposed over and in direct contact with base layer 210.

In an exemplary embodiment, auxetic layer 220 includes a plurality of apertures 231 (also referred to simply as apertures 231). Plurality of apertures 231 extend vertically through the entire thickness of auxetic layer 220 and form openings between a top surface 221 and an opposite, bottom surface 223 of auxetic layer 220. The top surface 221 of auxetic layer 220 is configured to be disposed beneath a foot of a wearer, and the opposite, bottom surface 223 of auxetic layer 220 is configured to be placed in contact (e.g. direct contact) with base layer 210. The openings (e.g., thru-holes) formed by apertures 231 extending through auxetic layer 220 permit a portion of base layer 210 to extend upwards through apertures 231 from the bottom surface 223 to the top surface 221 of auxetic layer 220. In some embodiments, plurality of apertures 231 could include polygonal apertures. In other embodiments, however, each aperture 231 could have any other geometry, including geometries with non-linear edges that connect adjacent vertices. In the embodiment shown in FIG. 2, apertures 231 appear as three-pointed stars (also referred to herein as triangular stars or as tri-stars). For example, one or more of the apertures 231 may have a simple isotoxal star-shaped polygonal shape.

Figure 3:
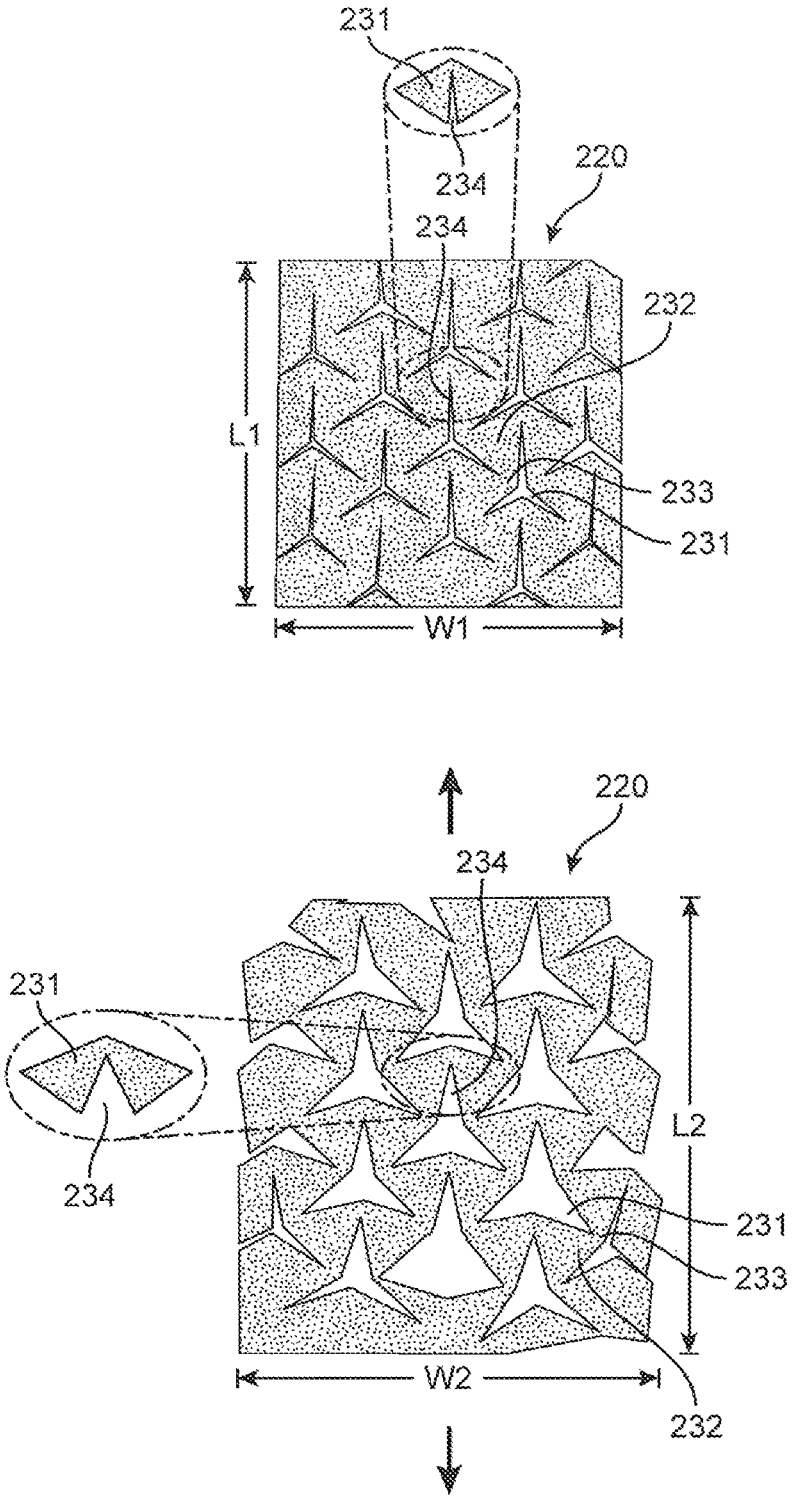
FIG. 3 is a schematic diagram illustrating the behavior of auxetic materials when tension is applied in a given direction.

Referring now to FIG. 3, an enlarged portion of auxetic layer 220 is illustrated in isolation to better describe the geometric properties of auxetic layer 220. In some embodiments, plurality of apertures 231 are surrounded by plurality of body elements 232 (also referred to simply as body elements 232). In this exemplary embodiment, body elements 232 are triangular. In other embodiments, the apertures 231 may have other geometries and may be surrounded by body elements 232 having other geometries. For example, the body 232 elements may be geometric features. The triangular features of body elements 232 shown in FIG. 3 are one example of such geometric features. Other examples of geometric features that might be used as body elements are quadrilateral features, trapezoidal features, pentagonal features, hexagonal features, octagonal features, oval features and circular features.

In the embodiment shown in FIG. 3, the joints at the vertices 233 function as hinges, allowing the triangular body elements 232 to rotate as tension is applied to auxetic layer 220 of auxetic sole assembly 200. When auxetic layer 220 (or a portion thereof) of auxetic sole assembly 200 is under tension, this action allows the portion of auxetic layer 220 under tension to expand both in the direction under tension and in the direction in the plane of auxetic layer 220 that is orthogonal to the direction under tension.

Structures, such as auxetic layer 220, that expand in a direction orthogonal to the direction under tension, as well as in the direction under tension, are known as auxetic structures. FIG. 3 schematically illustrates how the geometries of apertures 231 and their surrounding body elements 232 result in the auxetic behavior of a portion of auxetic layer 220 of auxetic sole assembly 200. FIG. 3 includes a comparison of a portion of an embodiment of auxetic layer 220 in its initial non-tensioned condition (shown in the top drawing) to a portion of that embodiment of auxetic layer 220 when it is under tension in a lengthwise direction (as shown in the bottom drawing).

Referring now to the drawing at the top of FIG. 3, a portion of auxetic layer 220 that has a width W1 and a length L1 in its initial non-tensioned condition is shown. In its non-tensioned condition, the portion of auxetic layer 220 has apertures 231 surrounded by body elements 232. Each pair of body elements 232 are joined at their vertices 233, leaving openings 234. In the embodiment shown in FIG. 3, apertures 231 are triangular star-shaped apertures, body elements 232 are triangular features, and openings 234 are the points of triangular star-shaped apertures 231. As best shown in the blow-up above the top drawing, in this embodiment, openings 234 may be characterized as having a relatively small acute angle when the portion of auxetic layer 220 is not under tension in the non-tensioned condition.

Referring now to the drawing at the bottom of FIG. 3, the bi-directional expansion of auxetic layer 220 (a portion thereof) when it is under tension in one direction is shown. In this embodiment, the application of tension in the direction shown by the arrows in the bottom drawing to auxetic layer 220 rotates adjacent body elements 232, which increases the relative spacing between adjacent body elements 232. For example, as clearly seen in FIG. 3, the relative spacing between adjoining body elements 232 (and thus the size of apertures 231) increases with the application of tension. Because the increase in relative spacing occurs in all directions (due to the geometry of the original geometric pattern of apertures), this results in an expansion of auxetic layer 220 along both the direction under tension, and along the direction orthogonal to the direction under tension.

For example, in the exemplary embodiment shown in FIG. 3, in the initial or non-tensioned condition (seen in the top drawing in FIG. 3), of the portion of auxetic layer 220 has an initial size L1 (e.g., initial length) along one direction (e.g., the longitudinal direction) and an initial size W1 (e.g., initials width) along a second direction that is orthogonal to the first direction (e.g., the lateral direction). In the expanded or tensioned condition (seen in the bottom drawing in FIG. 3), the portion of auxetic layer 220 has an increased size L2 (e.g., increased length) in the direction under tension and an increased size W2 (e.g., increased width) in the direction that is orthogonal to the direction under tension. Thus, it is clear that the expansion of portion of auxetic layer 220 is not limited to expansion in the direction under tension. With this configuration, upon application of tension to auxetic layer 220 in one of the longitudinal direction or lateral direction, auxetic layer 220 expands in both the longitudinal direction and the lateral direction.

In some embodiments, the auxetic behavior of auxetic layer 220 may be combined with the softer material of base layer 210 to form auxetic sole assembly 200 that can provide proprioceptive feedback to a foot of a wearer. In the exemplary embodiments, the combined features of the auxetic behavior of auxetic layer 220, which causes apertures 231 to open and enlarge upon the application of tension or force, and the relative degree of rigidities between auxetic layer 220 and base layer 210 can cause protuberances made of the material forming base layer 210 to extend upwards through apertures 231 of auxetic layer 220 to contact the foot of a wearer upon application of tension or force. With this arrangement, proprioceptive feedback can be provided to assist the wearer in determining enhanced awareness of the location, orientation, and/or movement of a foot disposed within article 100 relative to the wearer's body and/or the ground.

Figure 4:
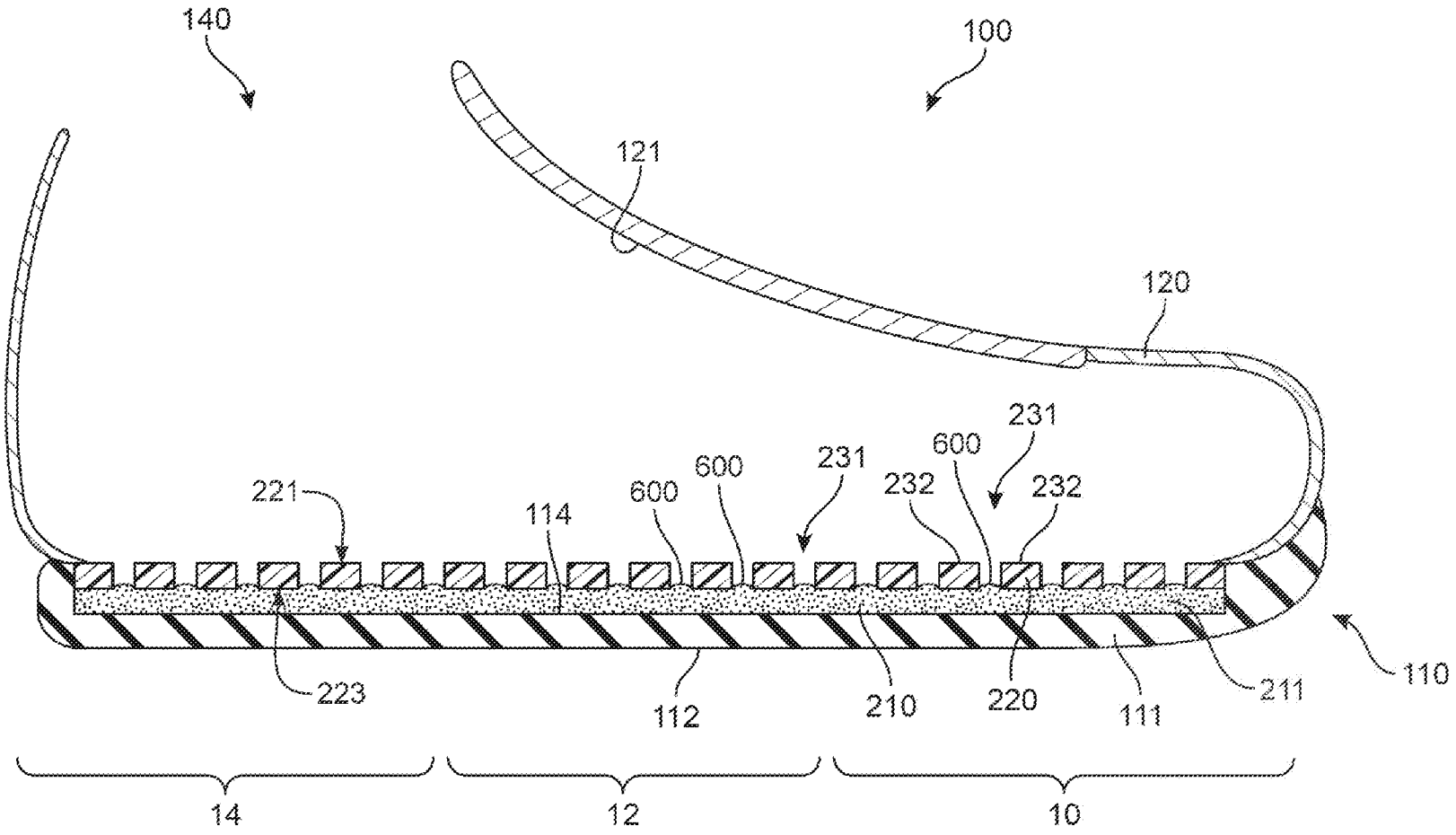
FIG. 4 is a representational cross-sectional view of an exemplary embodiment of an article of footwear including an auxetic sole assembly.

FIG. 4 illustrates a cross-sectional view of article 100 showing the arrangement of sole structure 110 relative to upper 120 of article 100. As shown in this embodiment, upper 120 includes an interior cavity 121 configured to receive a foot of a wearer through throat opening 140. Sole structure 110 is attached to upper 120 and is configured to be disposed between a foot of the wearer inside the interior cavity 121 of upper 120 and the ground. In this embodiment, sole structure 110 includes auxetic sole assembly 200 and outsole 111. Lower surface 112 of outsole 111 is in contact with the ground and upper surface 114 of outsole 111 is in contact with auxetic sole assembly 200. As a non-limiting example, the upper surface 114 of the outsole 111 may be in direct contact with the auxetic sole assembly 200.

As described above, auxetic sole assembly 200 can include auxetic layer 220 and base layer 210. In this embodiment, base layer 210 is disposed adjacent to and in contact (e.g., direct contact) with upper surface 114 of outsole 111. Base layer 210 is also disposed adjacent to and in contact (e.g., direct contact) with the bottom side of auxetic layer 220 such that base layer 210 is disposed between auxetic layer 220 and upper surface 114 of outsole 111. In an exemplary embodiment, sole structure 110, including outsole 111 and auxetic sole assembly 200, extend through the length of article 100 in the longitudinal direction and are disposed in at least a portion of each of forefoot region 10, midfoot region 12, and heel region 14. In addition, sole structure 110, including outsole 111 and auxetic sole assembly 200, also extend through the width of article 100 in the lateral direction between opposite medial side 16 and lateral side 18.

In this embodiment, auxetic sole assembly 200 is configured to extend between the interior cavity 121 of upper 120 and outsole 111. Auxetic layer 220 is disposed above base layer 210 such that in an initial non-tensioned condition, base layer 210 remains beneath the top side of auxetic layer 220 and does not extend into the interior of upper 120. In some embodiments, when auxetic layer 220 is resting in contact with base layer 210, protuberances 600 of base layer 210 to form bulges within apertures 231 of auxetic layer 220. As shown in FIG. 4, the bulges 400 of base layer 210 are disposed within apertures 231 between adjacent body elements 232 of auxetic layer 220. The base layer 210 can therefore include a main base body 211 and protuberances 600 protruding from the base body 211 in a direction away from the outsole 111 and into respective apertures 231.

In some embodiments, upon application of force F to auxetic sole assembly 200, protuberances 600 of base layer 210 disposed within plurality of apertures 231 can extend out from plurality of apertures 231 in auxetic layer 220 and rise above the top surface of auxetic layer 220. Thus, the base layer 210 has a first state and a second state. When no or negligible downward force is applied to the auxetic sole assembly 200, base layer 210 is in the first state. In the first state, the protuberances 600 are entirely disposed inside the respective apertures 231 but do not extend through the entirety of the apertures 231 and are therefore entirely disposed below the top surface 221 of the auxetic layer 220. As a downward force F is applied to the auxetic layer assembly 200, base layer 210 transitions from the first state to the second state. In the second state, the protuberances 600 extend through the entire thickness of the auxetic layer 220 via the apertures 231. In other words, the protuberances 600 extend through the apertures 231 beyond and above the top surface 221 of the auxetic layer 220 and into the interior cavity 121. To assist in the transition between the first state and the second state, base layer 210 may be wholly or partly made of a gelatinous material. Regardless of the specific materials employed, the material wholly or partly forming base layer 220 is less rigid than the material wholly or partly forming the auxetic layer. Regardless of whether a force is applied to the auxetic sole assembly 200, no portion of the base layer 210 extends through (or into) the outsole 111.

Figure 5:
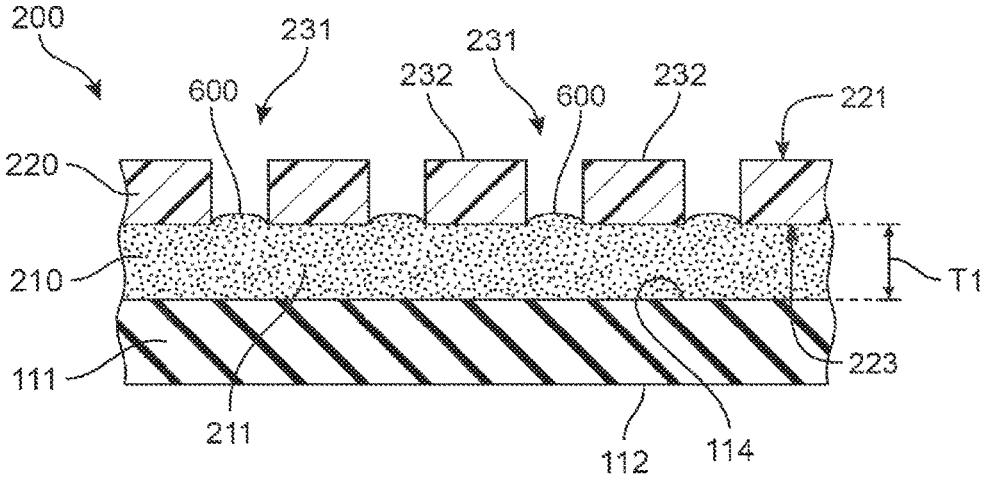
FIG. 5 is an enlarged view of a portion of an auxetic sole assembly of an article of footwear in a non-tensioned condition.

Referring now to FIG. 5, an enlarged view of a portion of auxetic sole assembly 200 is illustrated in the non-tensioned condition. In this non-tensioned condition, protuberances 600 of base layer 210 are disposed within apertures 231 between adjacent body elements 232 of auxetic layer 220. Prior to the application of force, the base body 211 of the base layer 210 can have a first thickness T1 extending between upper surface 114 of outsole 111 and a bottom surface 223 of auxetic layer 220.

Figure 6:
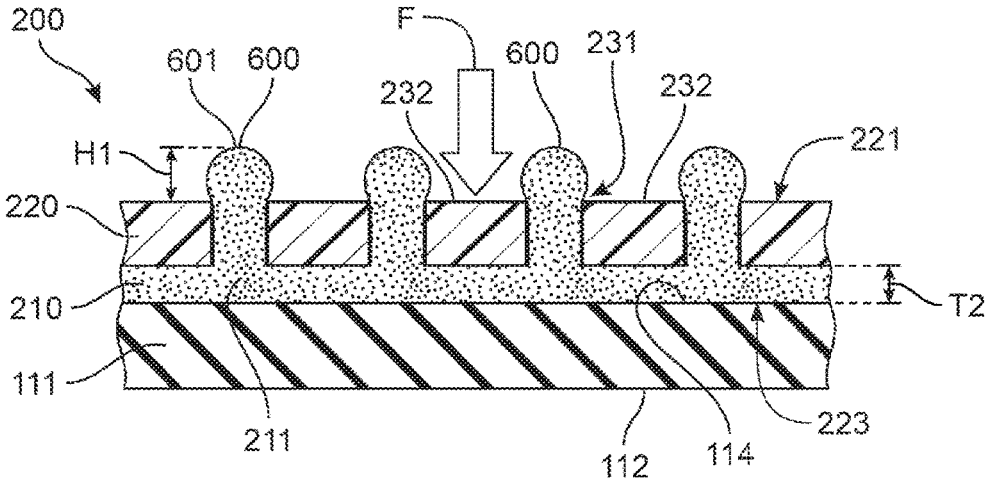
FIG. 6 is an enlarged view of a portion of an auxetic sole assembly of an article of footwear in a tensioned condition.

FIG. 6 illustrates an enlarged view of a portion of auxetic sole assembly 200 in the tensioned condition. Upon application of force F, for example, when a foot of a wearer presses down onto sole structure 110 during activity, auxetic layer 220 is pressed into base layer 210. Because upper surface 114 of outsole 111 and auxetic layer 220 are made of materials that are more rigid than base layer 210, a majority of base layer 210 is pressed, causing the base body 211 to have a second thickness T2 that is less than first thickness T1 in the non-tensioned condition. In addition, the application of force F causes protuberances 600 of base layer 210 to be forced up between plurality of apertures 231 in auxetic layer 220. As shown in FIG. 6, plurality of protuberances 600 extend out from plurality of apertures 231 and rise above the top surface 221 of auxetic layer 220 by a first height H1. In other words, the first height H1 is the distance from the top surface 221 of the auxetic layer 220 to the uppermost point 601 of the protuberances 600. With this arrangement, plurality of protuberances 600 can be configured to provide proprioceptive feedback to a foot of a wearer.

Figure 7:
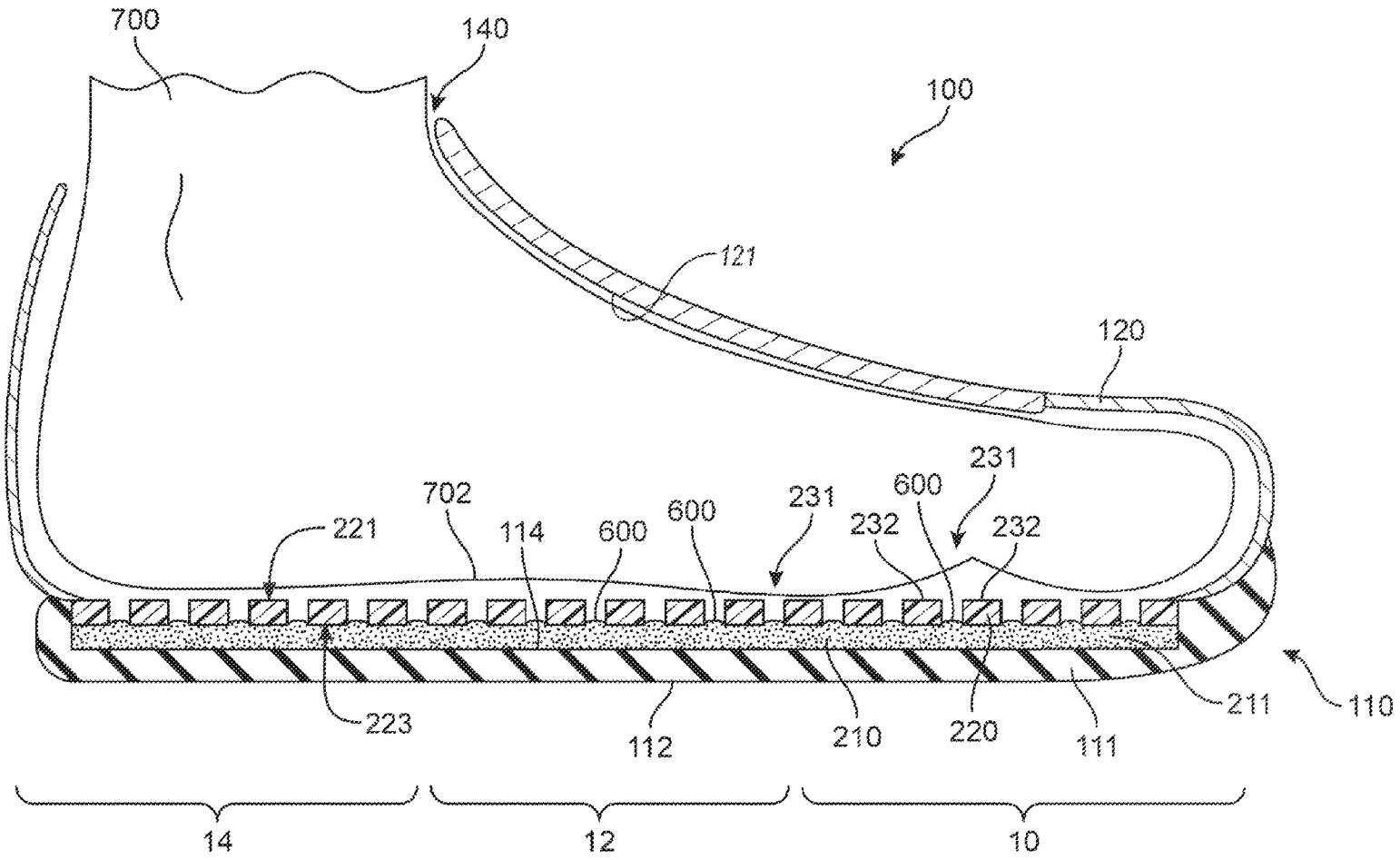
FIG. 7 is a representational cross-sectional view of an exemplary embodiment of an article of footwear including an auxetic sole assembly in a non-tensioned condition.

FIG. 7 illustrates a representative illustration of a foot 700 of a wearer disposed within article 100. In this embodiment, auxetic sole assembly 200 is configured to extend between foot 700 and outsole 111 when foot 700 is disposed within the interior of upper 120. Auxetic layer 220 is disposed above base layer 210 such that in an initial non-tensioned condition, auxetic layer 220 may be in contact with portions of foot 700, for example, underside 702 of foot 700. Base layer 210 remains beneath the top surface 221 of auxetic layer 220 and does not contact underside 702 of foot 700. Protuberances 600 of the material of base layer 210 may be disposed within apertures 231 of auxetic layer 220 between adjacent body elements 232 and can extend slightly above bottom surface 223 of auxetic layer 220 due to pressure from foot 700. In this non-tensioned condition, however, protuberances 600 remain below the top surface 221 of auxetic layer 220.

Figure 8:
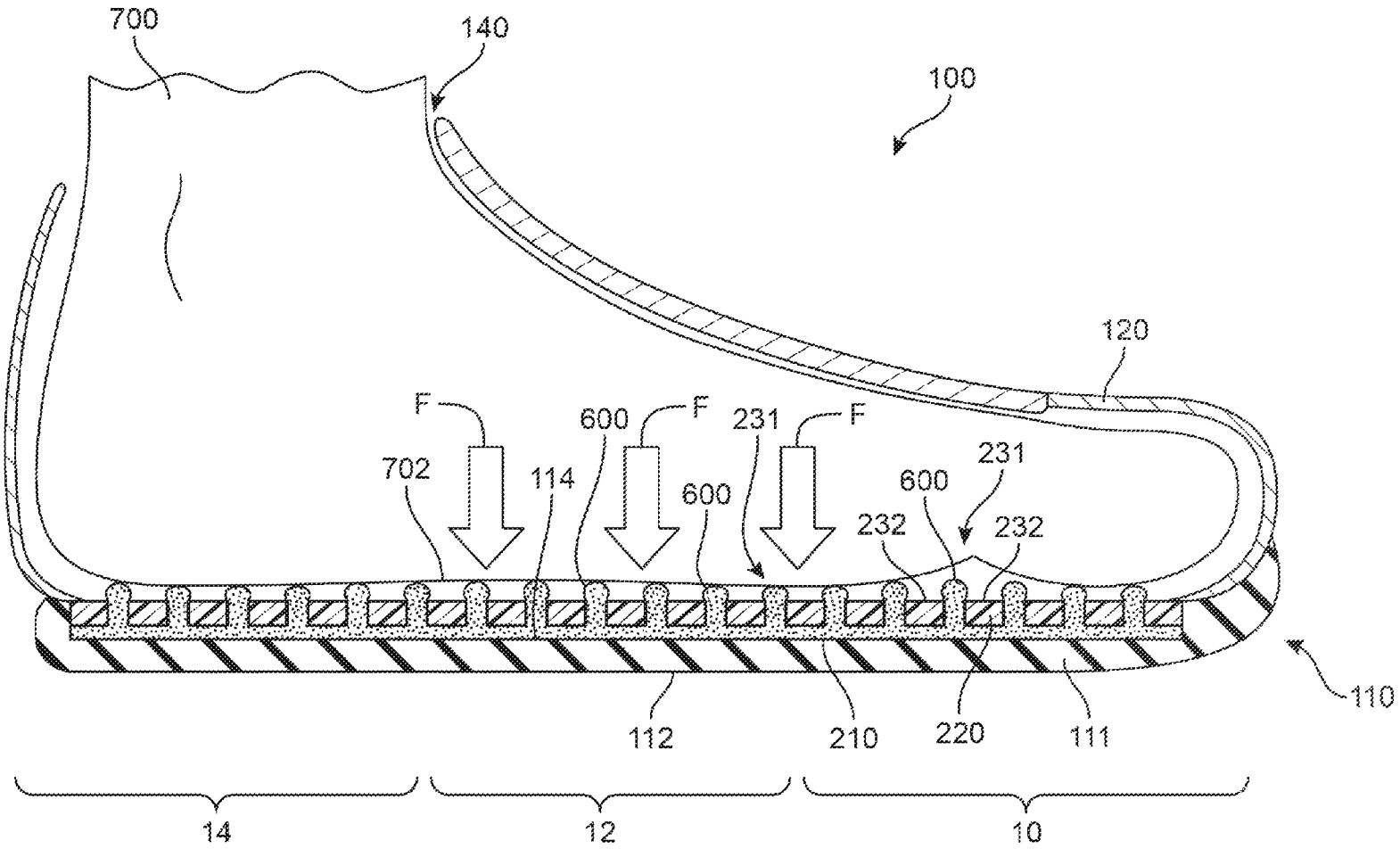
FIG. 8 is a representational cross-sectional view of an exemplary embodiment of an article of footwear including an auxetic sole assembly in a tensioned condition.

Referring now to FIG. 8, a representational cross-sectional view of article 100 including auxetic sole assembly 200 in a tensioned condition is illustrated. In some embodiments, upon application of a vertical downward force F by foot 700 to auxetic sole assembly 200, protuberances 600 of base layer 210 disposed within plurality of apertures 231 extend out from plurality of apertures 231 in auxetic layer 220 and rise above the top surface 221 of auxetic layer 220 to contact underside 702 of foot 700. With this arrangement, plurality of protuberances 600 can be configured (i.e., constructed and/or designed) to provide proprioceptive feedback to foot 700.

In some embodiments, the height of plurality of protuberances 600 extend out above top surface 221 of auxetic layer 220 can vary in proportion to the magnitude of force F applied to auxetic sole assembly 200, such that a larger applied force will cause protuberances 600 to have a larger height extending out from apertures 231 of auxetic layer 220. In other words, protuberances 600 are configured (i.e., constructed and designed) to change height dynamically as a function of a magnitude of the force F applied to the auxetic sole assembly 200. As a non-limiting example, the first height H1 from the top surface 221 of the auxetic layer 220 to the uppermost point 601 of the protuberances 600 is a function of the magnitude of the force F applied to the auxetic layer 220.

In addition, in some embodiments, application of force by a foot 700 against auxetic sole assembly 200 can include force components that are oriented along multiple directions. In the embodiment described with reference to FIG. 8, the exemplary force F applied by the foot 700 to auxetic sole assembly 200 was substantially oriented in the vertical direction. During typical activity or athletic maneuvers, forces applied by a foot of a wearer against a sole structure of an article of footwear can include force components that are oriented in the vertical direction, as well as force components that are oriented in the longitudinal direction and/or the lateral direction. For example, during cutting motions, a foot may apply both a downward force in the vertical direction and a lateral force in the lateral direction to the sole structure of the article of footwear. Similarly, other typical movements can have force components oriented in the vertical direction and the longitudinal direction. When such forces having components oriented along multiple directions are applied by a foot to auxetic sole assembly 200, the auxetic behavior of the auxetic layer 220, described above, may further assist with providing proprioceptive feedback to the foot of the wearer.

In some embodiments, the force component oriented in the vertical direction applied to auxetic sole assembly 200 can form protuberances 600 as described above. In addition, when force components oriented in other directions, for example, force components oriented in the longitudinal direction and/or lateral direction, are applied to auxetic sole assembly 200, the auxetic properties of auxetic layer 220 causes auxetic layer 220 to expand in both the lateral direction and the longitudinal direction upon the application of tension or force in either the lateral direction or the longitudinal direction. This expansion of the dimensions of auxetic layer 220 may cause the size of the openings formed by apertures 231 in auxetic layer 220 to increase and become larger. The larger openings of apertures 231 can permit a larger amount of the material forming base layer 210 to extend upwards and out from apertures 231 to form plurality of protuberances 600.

The auxetic behavior of auxetic layer 220 of auxetic sole assembly 200 under lateral tension or longitudinal tension can affect the height of protuberances 600. With this arrangement, protuberances 600 may have a larger height when a force is applied to auxetic sole assembly 200 that includes force components oriented in multiple directions as compared with a force that is substantially oriented in the vertical direction. Such differences in height of protuberances 600 under different force components can assist with providing proprioceptive feedback to the wearer for determining enhanced awareness of the location, orientation, and/or movement of a foot disposed within article 100.

In some embodiments, different portions of a sole structure 110 of an article of footwear 100 can be provided with varying amounts or sizes of protuberances 600 for proprioception. FIGS. 9-12 illustrate a first alternate embodiment of an auxetic sole assembly 900 that may be used with sole structure 110 and article 100. The auxetic sole assembly 900 includes a forefoot assembly 980 region, a midfoot assembly region 982, and a heel assembly region 984. Midfoot assembly region 982 is disposed between heel assembly region 984 and forefoot assembly region 982. Auxetic sole assembly 900 includes groups of protuberances having different heights. Protuberances with varying heights can provide different amounts or degrees of proprioceptive feedback to a foot of a wearer. In some cases, certain areas of a foot may be more sensitive and can receive or detect stimuli from protuberances better than other areas. In other cases, certain areas of the foot may be more useful or helpful for providing information about the location, orientation, and/or movement of the foot than other areas. For example, the majority of tension or force may be applied to a forefoot or heel region of a foot during typical athletic or sports activities and less tension or force may be applied to a midfoot region of the foot.

In an exemplary embodiment, auxetic sole assembly 900 includes multiple groups of protuberances having different heights. Auxetic sole assembly 900 includes a base layer 910 and an auxetic layer 920. Base layer 910 can be formed from a material that has a smaller degree or amount of rigidity than auxetic layer 920. In some cases, base layer 910 may be substantially similar to base layer 910 and auxetic layer 920 may be substantially similar to auxetic layer 220, described above with reference to auxetic sole assembly 200. With this configuration, when auxetic sole assembly 900 experiences a force, base layer 910 will be substantially deformed relative to auxetic layer 920 to form protuberances having different heights.

It is contemplated that the material wholly or partly forming base layer 910 may be more rigid than the material wholly or partly forming auxetic layer 920. In this embodiment, auxetic layer 920 deforms upon application of the force F to expose the protuberances 912.

In an exemplary embodiment, auxetic layer 920 includes a plurality of apertures 931 (also referred to simply as apertures 931). Plurality of apertures 931 extend vertically through the entire thickness of auxetic layer 920 and form openings between (and extending through) a top surface 921 and a bottom surface 923 of auxetic layer 920. The top surface 921 is opposite the bottom surface 923. The top surface 923 of auxetic layer 920 is configured to be disposed beneath a foot of a wearer, and the opposite bottom surface 923 of auxetic layer 920 is configured to be placed in contact (e.g., direct contact) with base layer 910. The openings formed by apertures 931 extending through auxetic layer 920 permit a portion (e.g., protuberances) of base layer 910 to extend upwards through apertures 931 from the bottom surface 921 to the top surface 921 of auxetic layer 920. Specifically, each protuberance can extend away from the bottom surface 923, through the entire thickness of auxetic layer 920 via the apertures 931, and out of the auxetic layer 920 beyond the top surface 921.

In this embodiment, base layer 910 of auxetic sole assembly 900 includes a first group of protuberances 911, a second group of protuberances 912, and a third group of protuberances 913. First group of protuberances 911 can be located in forefoot assembly region 980, second group of protuberances 912 can be located in midfoot assembly region 982, and third group of protuberances 913 can be located in heel assembly region 984.

In one embodiment, larger protuberances of first group of protuberances 911 are provided in forefoot assembly region 980 than the protuberances of second group of protuberances 912 in midfoot region 12. Thus, each protuberance 911 of the first group of protuberances 911 is larger than each protuberance 912 of the second group of protuberances 912. Similarly, larger protuberances of third group of protuberances 913 can be provided in heel assembly region 984 than the protuberances of second group of protuberances 912 in midfoot assembly region 982. Thus, each protuberance 913 of the third group of protuberances 913 is larger than each protuberance 912 of the third group of protuberances 912. In some cases, the forefoot region of a foot can be the most sensitive portion and/or the most useful for determining location, orientation, and/or movement stimuli. In one embodiment, therefore, the protuberances of first group of protuberances 911 in forefoot assembly region 980 can also be larger than the protuberances of third group of protuberances 913 in heel assembly region 984. The differences in protuberance sizes described in this paragraph assist in providing adequate amount of proprioceptive feedback in the forefoot region, the midfoot region, and the heel region of the wearer's foot without causing discomfort.

Figure 10:
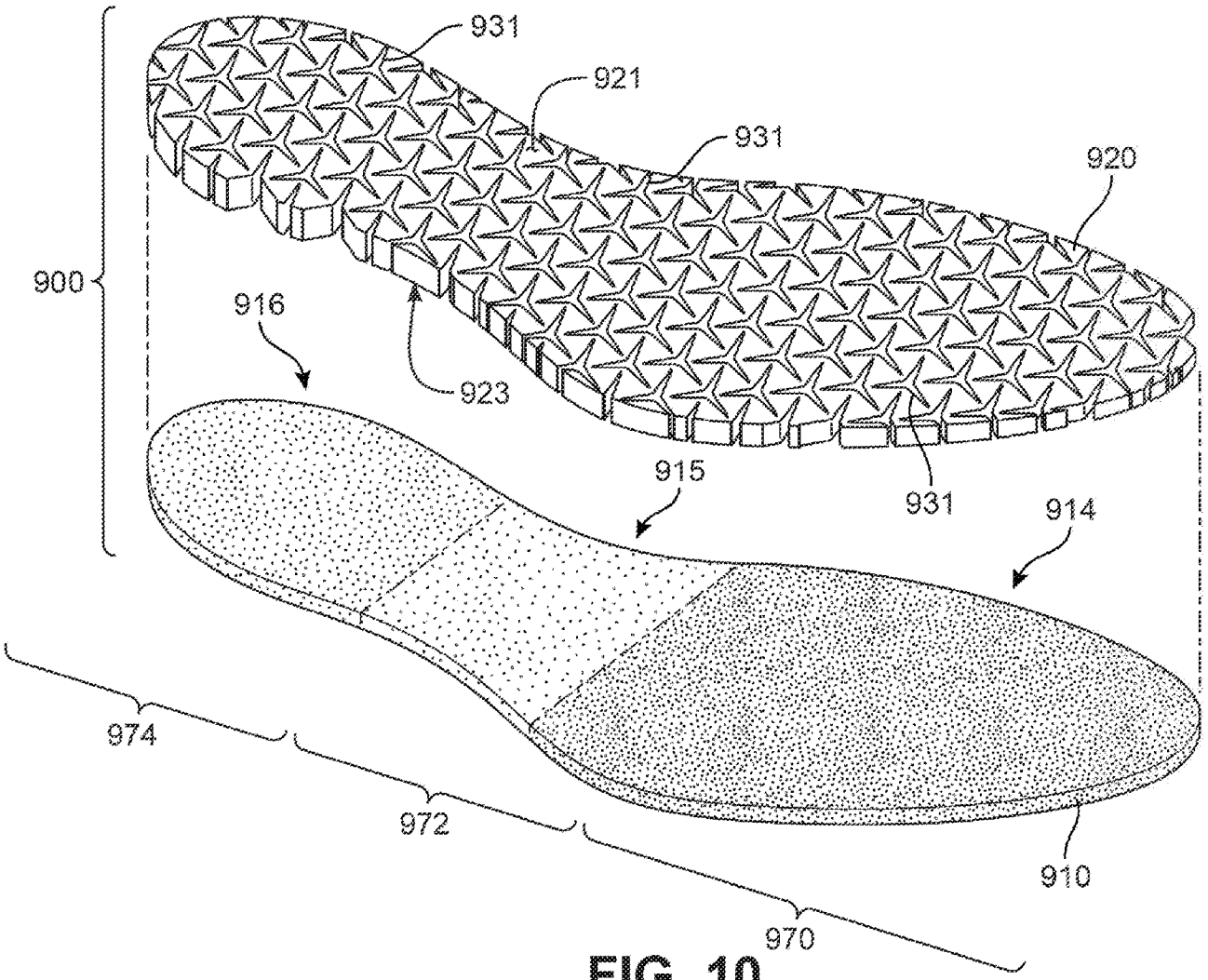
FIG. 10 is an exploded view of an alternate embodiment of an auxetic sole assembly having varying sized protuberances.

The heights or sizes of protuberances can be varied by different methods. In one embodiment, the relative rigidity of materials forming base layer in different locations can be varied so that the protuberances are larger or smaller. Referring now to FIG. 10, in an exemplary embodiment, a first material 914 forming forefoot base region 970 of base layer 910 can be a low-density foam or another material having a small amount of rigidity so that protuberances formed under tension or force applied to auxetic sole assembly 900 in forefoot base region 970 are larger than in other regions (i.e., midfoot base region 972 and/or heel base region 974) of auxetic sole assembly 900. Similarly, a third material 916 forming heel base region 974 of base layer 910 can be a medium density foam or another material having a greater amount of rigidity than first material 914 forming forefoot base region 970 so that protuberances formed under tension or force applied to auxetic sole assembly 900 in heel base region 974 are larger than the protuberances in midfoot base region 972 of auxetic sole assembly 900, but are smaller than the protuberances in forefoot base region 970 of auxetic sole assembly 900. A second material 915 can form midfoot base region 972 of base layer 910 that has a higher density and/or is more rigid than first material 914 and third material 916 so that protuberances formed under tension or force applied to auxetic sole assembly 900 in midfoot base region 972 are smaller than protuberances in each of forefoot base region 970 and heel base region 974.

In one exemplary embodiment, first group of protuberances 911 may be formed by first material 914 of body layer 910, second group of protuberances 912 may be formed by second material 915 of body layer 910, and third group of protuberances 913 may be formed by third material 916 of body layer 910. With this configuration, the height of each group of protuberances can, at least in part, be determined by the density and/or rigidity of the material forming the protuberances. As will be described further below, the height of each group of protuberances can also be determined by the size of the aperture in the auxetic layer 920 through which the material of body layer 910 extends.

Figure 11:
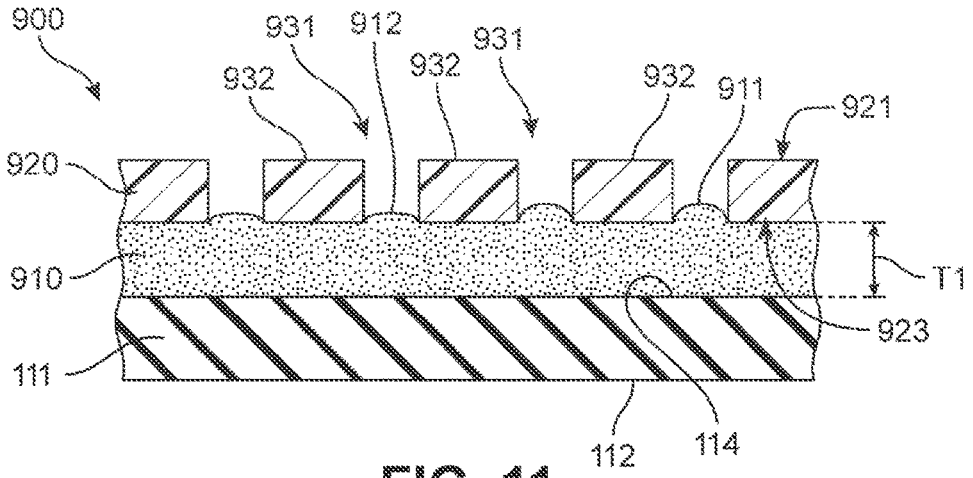
FIG. 11 is an enlarged view of a portion of an alternate embodiment of an auxetic sole assembly in a non-tensioned condition.
Figure 12:
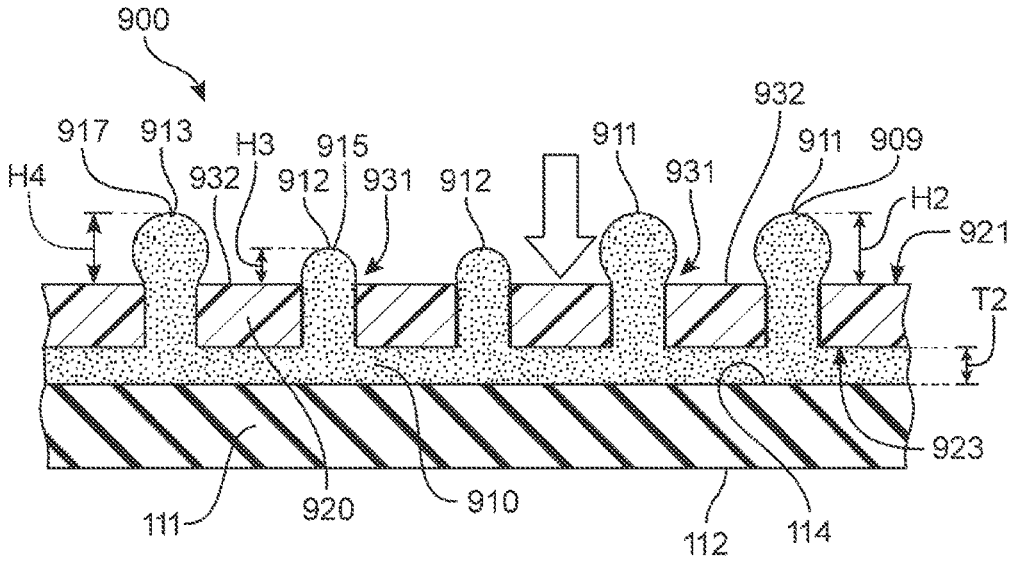
FIG. 12 is an enlarged view of a portion of an alternate embodiment of an auxetic sole assembly in a tensioned condition.

FIGS. 11 and 12 illustrate enlarged views of portions of auxetic sole assembly 900 having different sized protuberances. In some embodiments, upon application of force to auxetic sole assembly 900, protuberances of base layer 910 disposed within plurality of apertures 931 can have different sizes and extend out from plurality of apertures 931 in auxetic layer 920 and rise above the top surface 921 of auxetic layer 920.

Referring now to FIG. 11, an enlarged view of a portion of auxetic sole assembly 900 is illustrated in the non-tensioned condition. In this non-tensioned condition, a first protuberances 911 of base layer 910 are disposed within apertures 931 between adjacent body elements 932 of auxetic layer 920 in forefoot assembly region 970 (FIG. 9) of auxetic sole assembly 900 and a second protuberances 912 of base layer 910 is disposed within apertures 931 between adjacent body elements 932 of auxetic layer 920 in midfoot assembly region 972 (FIG. 10) of auxetic sole assembly 900. Prior to the application of force, base layer 910 can have first thickness T1 extending between upper surface 114 of outsole 111 and the bottom side of auxetic layer 920.

FIG. 12 illustrates an enlarged view of a portion of auxetic sole assembly 900 in the tensioned condition. Upon application of force, for example, when a foot of a wearer presses down onto sole structure 110 during activity, auxetic layer 920 is pressed into base layer 910. Because upper surface 114 of outsole 111 and auxetic layer 920 are made of materials that are more rigid than base layer 910, a majority of base layer 910 is pressed to second thickness T2 that is less than first thickness T1 in the non-tensioned condition. In addition, the application of force causes portions of base layer 910 to be forced up between plurality of apertures 931 in auxetic layer 920. The protuberances of base layer 910 that extend upwards and out from plurality of apertures 931 in auxetic layer 920 have different heights in different regions of auxetic sole assembly 900.

As shown in FIG. 12, first group of protuberances 911 extend out from plurality of apertures 931 and rise above the top surface 921 of auxetic layer 920 by a second height H2 in forefoot assembly region 980. The second height H2 is a distance from the top surface 921 to the uppermost portion 909 of the protuberance 911. Second group of protuberances 912 extend out from plurality of apertures 931 and rise above the top surface 921 of auxetic layer 920 by a third height H3 in midfoot assembly region 982. The third height H3 is a distance from the top surface 921 to the uppermost portion 915 of the protuberance 912. In this embodiment, second height H2 of first group of protuberances 911 is larger than third height H3 of second group of protuberances 912. Third group of protuberances 913 extend out from plurality of apertures 931 and rise above the top surface 921 of auxetic layer 920 by a fourth height H4 in heel assembly region 984. The third height H4 is a distance from the top surface 921 to the uppermost portion 915 of the uppermost portion 917 of protuberance 913. In this embodiment, fourth height H4 of third group of protuberances 913 is larger than third height H3 of second group of protuberances 912. With this arrangement, protuberances of different heights, including first group of protuberances 911, second group of protuberances 912, and third group of protuberances 913, can be configured to provide proprioceptive feedback to a foot of a wearer related to different regions of auxetic sole assembly 900 without causing discomfort to the wearer.

Figure 13:
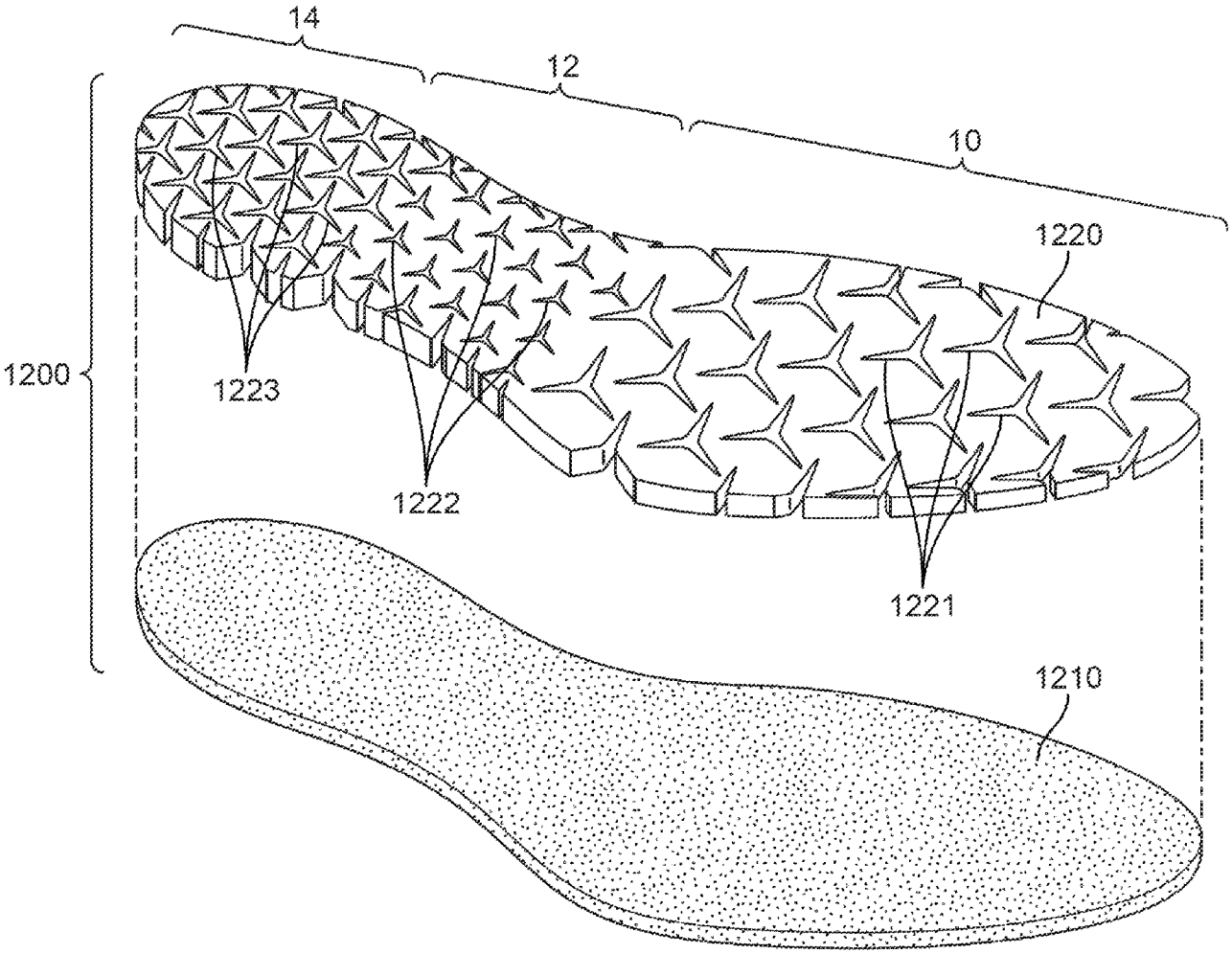
FIG. 13 is an exploded view of an alternate embodiment of an auxetic sole assembly having varying sized apertures.
Figure 14:
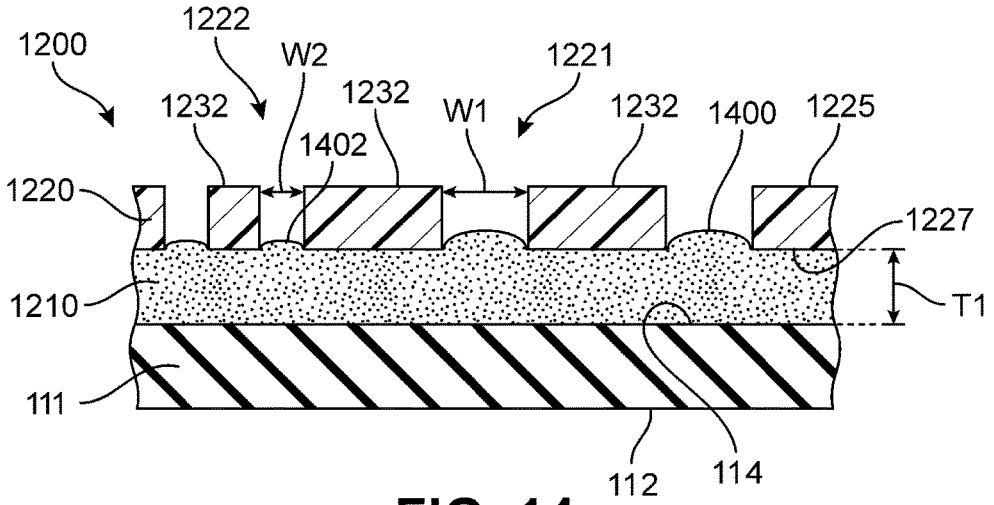
FIG. 14 is an enlarged view of a portion of an alternate embodiment of an auxetic sole assembly in a non-tensioned condition.
Figure 15:
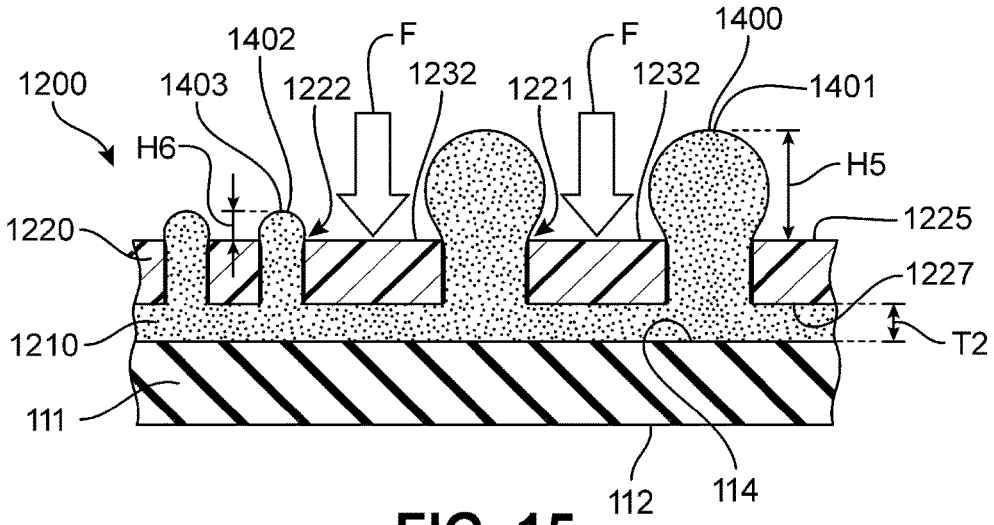
FIG. 15 is an enlarged view of a portion of an alternate embodiment of an auxetic sole assembly in a tensioned condition.

In other embodiments, the size of protuberances can also be varied by changing the size of the apertures formed in the auxetic layer to permit more or less of the material forming the base layer to extend upwards through the apertures. FIGS. 13-15 illustrate a second alternate embodiment of an auxetic sole assembly 1200 that may be used with sole structure 110 and article 100. Auxetic sole assembly 1200 includes multiple groups of apertures having different sizes. Referring now to FIG. 13, auxetic sole assembly 1200 includes a base layer 1210 and an auxetic layer 1220. Base layer 1210 can be formed from a material that has a smaller degree or amount of rigidity than auxetic layer 1220. In some cases, base layer 1210 may be substantially similar to base layer 1210 and auxetic layer 1220 may be substantially similar to auxetic layer 1220, described above with reference to auxetic sole assembly 200. With this configuration, when auxetic sole assembly 1200 experiences a force, base layer 1210 will be substantially deformed relative to auxetic layer 1220 to form protuberances having different heights.

Figure 9:
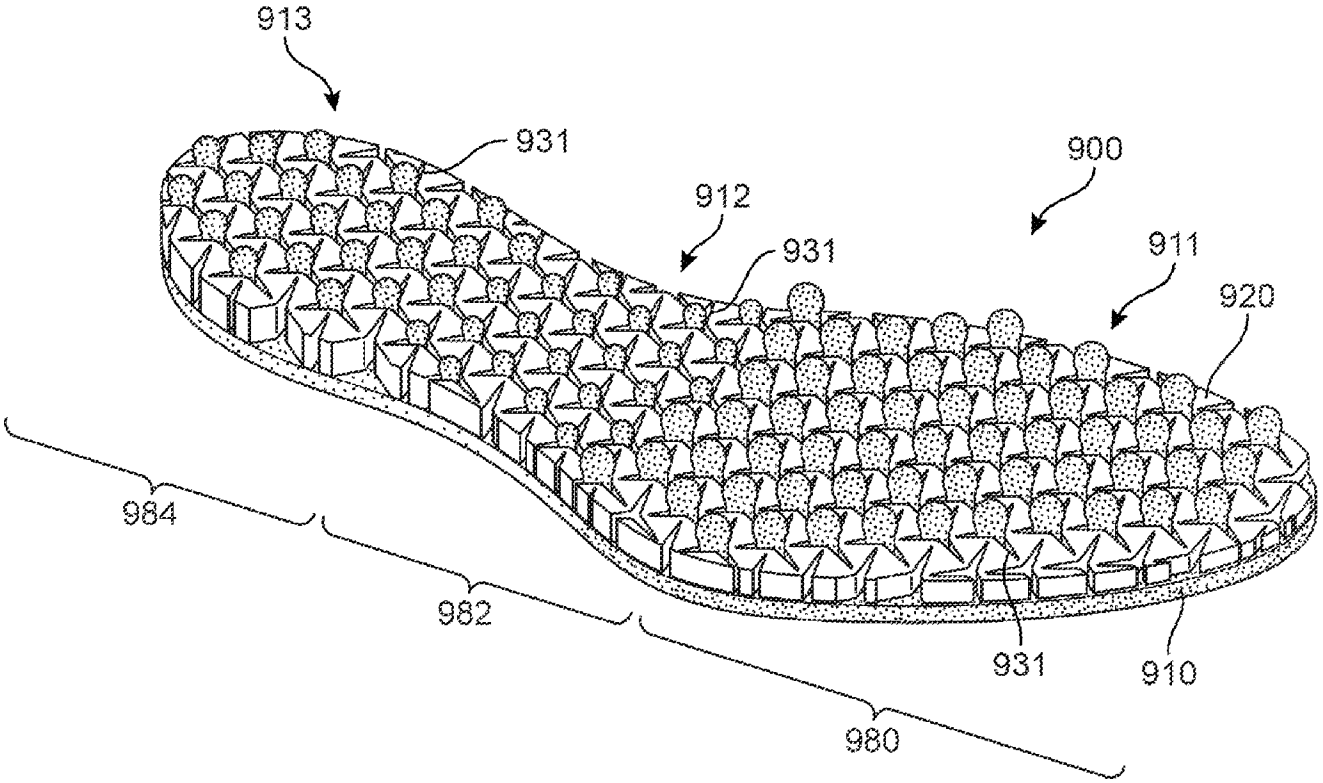
FIG. 9 is a representational view of an alternate embodiment of an auxetic sole assembly having varying sized protuberances.

In an exemplary embodiment, auxetic layer 1220 includes a plurality of apertures having different sizes. In this embodiment, auxetic layer 1220 of auxetic sole assembly 1200 includes a first group of apertures 1221, a second group of apertures 1222, and a third group of apertures 1223. First group of apertures 1221 can be located in forefoot assembly region 980 (FIG. 9), second group of apertures 1222 can be located in midfoot assembly region 982 (FIG. 9), and third group of apertures 1223 can be located in heel assembly region 984 (FIG. 9).

Each of the apertures of first group of apertures 1221, second group of apertures 1222, and third group of apertures 1223 extends vertically through the entire thickness of auxetic layer 1220 and forms an opening between a top surface 1225 and an opposite, bottom surface 1227 of auxetic layer 1220. The top surface 1225 of auxetic layer 1220 is configured to be disposed beneath a foot of a wearer, and the opposite, bottom surface 1227 of auxetic layer 1220 is configured to be placed in contact (e.g., direct contact) with base layer 1210. The openings formed by apertures of first group of apertures 1221, second group of apertures 1222, and third group of apertures 1223 extend through auxetic layer 1220 to permit a portion of base layer 1210 to extend upwards through the apertures from the bottom surface 1227 to (and through) the top surface 1225 of auxetic layer 1220.

In one embodiment, the size of each of the first group of apertures 1221, which are provided in forefoot assembly region 980, is greater than the size of each of the second group of apertures 1222 in midfoot assembly region 982. Similarly, the size of each of the third group of apertures 1223, which are provided in heel assembly region 984, is greater than the size of each of the second group of apertures 1222 in midfoot assembly region 982. In some cases, the forefoot region of a foot can be the most sensitive portion and/or the most useful for determining location, orientation, and/or movement stimuli. In one embodiment, therefore, the size of each of the first group of apertures 1221 in forefoot assembly region 980 can also be greater than the size of each of the third group of apertures 1223 in heel assembly region 984.

In this embodiment, the heights or sizes of protuberances can be varied by providing different sized openings in the apertures of auxetic layer 1220. For example, in an exemplary embodiment, openings of apertures in auxetic layer 1220 in forefoot region 10 can be larger so that protuberances formed under tension or force applied to auxetic sole assembly 1200 in forefoot region 10 are larger than in other regions of auxetic sole assembly 1200. Similarly, openings of apertures in auxetic layer 1220 in heel region 14 can be sized so that protuberances formed under tension or force applied to auxetic sole assembly 1200 in heel region 14 are larger than the protuberances in midfoot region 12 of auxetic sole assembly 1200, but are smaller than the protuberances in forefoot region 10 of auxetic sole assembly 1200.

FIGS. 14 and 15 illustrate enlarged views of portions of auxetic sole assembly 1200 having apertures with different sized openings to form different sized protuberances. In some embodiments, upon application of force to auxetic sole assembly 1200, portions of base layer 1210 disposed within the different sized apertures of auxetic layer 1220 can form different sized protuberances that extend out from the apertures in auxetic layer 1220 and rise above the top side of auxetic layer 1220. Referring now to FIG. 14, an enlarged view of a portion of auxetic sole assembly 1200 is illustrated in the non-tensioned condition. In this non-tensioned condition, protuberances 1400, 1402 of base layer 1210 are disposed within an aperture of first group of apertures 1221 between adjacent body elements 1232 of auxetic layer 1220 in forefoot region 10 of auxetic sole assembly 1200 and within an aperture of second group of apertures 1222 between adjacent body elements 1232 of auxetic layer 1220 in midfoot region 12 of auxetic sole assembly 1200. Prior to the application of force, base layer 1210 can have first thickness T1 extending between upper surface 114 of outsole 111 and the bottom surface 1227 of auxetic layer 1220.

FIG. 15 illustrates an enlarged view of a portion of auxetic sole assembly 1200 in the tensioned condition. Upon application of force, for example, when a foot of a wearer presses down onto sole structure 110 during activity, auxetic layer 1220 is pressed into base layer 1210. Because upper surface 114 of outsole 111 and auxetic layer 1220 are made of materials that are more rigid than base layer 1210, a majority of base layer 1210 is pressed to second thickness T2 that is less than first thickness T1 in the non-tensioned condition. In addition, the application of force causes portions of base layer 1210 to be forced up between the different sized apertures in auxetic layer 1220. The portions of base layer 1210 that extend upwards and out from the different sized apertures in auxetic layer 1220 form protuberances having different heights in different regions of auxetic sole assembly 1200.

As shown in FIG. 15, first sized protuberance 1400 extends out from an aperture of first group of apertures 1221 and rises above the top surface 1225 of auxetic layer 1220 by a fifth height H5 in forefoot assembly region 980. The fifth height H5 is a distance from the top surface of the auxetic layer 1220 to an uppermost portion 1401 of the protuberance 1400. A second sized protuberance 1402 extends out from an aperture of second group of apertures 1222 and rises above the top surface 1225 of auxetic layer 1220 by a sixth height H6 in midfoot assembly region 982. The sixth height H6 is a distance from the top surface 1225 of the auxetic layer 1220 to an uppermost portion 1403 of the protuberance 1402. In this embodiment, fifth height H5 of first sized protuberance 1400 is larger than sixth height H6 of second sized protuberance 1402. With this arrangement, protuberances of different heights, including first sized protuberance 1400 and second sized protuberance 1402, can be configured to provide adequate proprioceptive feedback to a foot of a wearer related to different regions of auxetic sole assembly 1200 without causing discomfort to the wearer.

In other embodiments, various features of the embodiments of one or more of auxetic sole assembly 200, auxetic sole assembly 900, and auxetic sole assembly 1200 can be combined together in different combinations to provide a sole structure having an auxetic sole assembly with desired proprioceptive feedback according to the principles of the embodiments described herein.

While various embodiments of the presently disclosed sole structure and article of footwear have been described, the description is intended to be exemplary, rather than limiting and it will be apparent to those of ordinary skill in the art that many more embodiments and implementations are possible that are within the scope of the present teachings. Accordingly, the present teachings are not to be restricted except in light of the attached claims and their equivalents. Also, various modifications and changes may be made within the scope of the attached claims.

What is claimed is:

1. An article of footwear comprising:

an upper; and a sole structure coupled to the upper, wherein the sole structure comprises:

an auxetic sole assembly including:

an auxetic layer defining a plurality of apertures; and a base layer disposed adjacent to the auxetic layer, wherein the base layer includes a base body and a plurality of protuberances extending from the base body, and each of the plurality of protuberances is disposed within a respective one of the plurality of apertures; and wherein the auxetic layer includes a first material, the base layer includes a second material, the first material is more rigid than a second material, and the second material is less rigid than the first material to allow the protuberances to extend out of the apertures upon application of force to the auxetic sole assembly.

2. The article of footwear according to claim 1, wherein the upper defines an interior cavity, the base layer has a first state and a second state, the base layer is configured to transition from the first state to the second state upon application of the force to the auxetic layer, each of the protuberances is entirely disposed inside the respective one of the plurality of apertures and is entirely disposed below a top surface of the auxetic layer when the base layer is in the first state, each of the protuberances extends through an entirety of a thickness of the auxetic layer via the respective one of the plurality of apertures such that each of the protuberances extends beyond and above the top surface of the auxetic layer and into the interior cavity of the upper when the base layer is in the second state.

3. The article of footwear according to claim 1, wherein the protuberances are configured to elastically deform in response to a force applied to the auxetic layer such that the protuberances change height as a function of a magnitude of the force.

4. The article of footwear according to claim 1, wherein the protuberances are configured to selectively extend beyond a surface of the auxetic layer to provide proprioceptive feedback to a foot of a wearer of the article of footwear.

5. The article of footwear according to claim 1, wherein the sole structure further comprises an outsole; and wherein the base layer is disposed between the auxetic layer and the outsole.

6. The article of footwear according to claim 5, wherein the outsole includes an outsole body and a sidewall portion coupled to the outsole body, the outsole body defines an upper surface, the upper surface and the sidewall portion collectively define the recess, and the sidewall surface surrounds the recess;

wherein the auxetic sole assembly is disposed within the recess; and wherein the sidewall portion extends around a periphery of the auxetic sole assembly.

7. A sole structure for an article of footwear, the sole structure comprising:

an auxetic sole assembly including:

an auxetic layer defining a plurality of apertures; and a base layer disposed adjacent to the auxetic layer, wherein the base layer includes a base body and a plurality of protuberances extending from the base body, and each of the protuberances are disposed within a respective one of the plurality of apertures; and wherein the protuberances of the base layer are configured to extend out from the plurality of apertures upon application of force to the auxetic sole assembly; and wherein the auxetic layer includes a first material, the base layer includes a second material, the first material is more rigid than a second material, and the second material is less rigid than the first material to allow the protuberances to extend out of the apertures upon application of force to the auxetic sole assembly.

8. The sole structure according to claim 7, wherein the protuberances are configured to change height in response to the application of the force to the auxetic sole assembly to provide proprioceptive feedback to a foot of a wearer of the sole structure, and wherein the change in height is a result of the auxetic layer impinging into the base layer in response to the force.

9. The sole structure according to claim 8, wherein the protuberances change height dynamically as a function of a magnitude of force applied to the auxetic sole assembly.

10. The sole structure according to claim 7, wherein the auxetic layer is an auxetic structure that:

expands in both a lateral direction and a longitudinal direction when the auxetic layer is under lateral tension; and expands in both the longitudinal direction and the lateral direction when the auxetic layer is under longitudinal tension.

11. The sole structure according to claim 10, wherein the protuberances extend at least partially within the plurality of apertures of the auxetic layer, and wherein the volume of the base layer disposed within the plurality of apertures in the auxetic layer increases when the auxetic layer expands.

12. A sole structure for an article of footwear, the sole structure comprising:

an auxetic sole assembly including a forefoot assembly region, a heel assembly region, and a midfoot assembly region disposed between the forefoot assembly region and the heel assembly region, wherein the auxetic sole assembly includes:

an auxetic layer defining a plurality of apertures; and a base layer disposed adjacent to the auxetic layer, wherein the base layer includes a base body and a plurality of protuberances extending from the base body, and each of the protuberances is disposed within a respective one of the plurality of apertures;

wherein the plurality of protuberances includes a first group of protuberances disposed in the forefoot assembly region, a second group of protuberances disposed in the midfoot assembly region, and a third group of protuberances disposed in the heel assembly region; and wherein the first group of protuberances has a first height, the second group of protuberances has a second height, and the first height is greater than the second height.

13. The sole structure according to claim 12, wherein the third group of protuberances has a third height; and wherein the third height is greater than the second height.

14. The sole structure according to claim 12, wherein the plurality of apertures in the auxetic layer includes first groups of apertures extending through the forefoot assembly region of the auxetic sole assembly, a second group of apertures extending through the midfoot assembly region of the auxetic sole assembly, and a third group of apertures extending through the heel assembly region of the auxetic sole assembly.

15. The sole structure according to claim 14, wherein the first group of apertures has a first size, the second group of apertures has a second size, and the first size is larger than the second size.

16. The sole structure according to claim 15, wherein the third group of apertures has a third size, and the third size is smaller than the first size.

17. The sole structure according to claim 12, wherein the base layer includes a forefoot base region, a heel base region, and a midfoot base region disposed between the forefoot base region and the heel base region, the forefoot base region includes a first material, the midfoot base region includes a second material, and the heel base region includes a third material, and the second material is more rigid than the first material and the third material.

* * * * *